US006889758B2

(12) United States Patent
Burgers et al.

(10) Patent No.: US 6,889,758 B2
(45) Date of Patent: May 10, 2005

(54) LATERAL PLATE FINNED HEAT EXCHANGER

(75) Inventors: Johny G. Burgers, Oakville (CA); Michael E. Davies, Stoney Creek (CA); Christopher R. Shore, Hamilton (CA); Stephen A. Beech, Mississauga (CA); Casey C. Brown, Calgary (CA)

(73) Assignee: Dana Canada Corporation, Oakville (CA)

( * ) Notice: Subject to any disclaimer, the term of this patent is extended or adjusted under 35 U.S.C. 154(b) by 0 days.

(21) Appl. No.: 10/453,361

(22) Filed: Jun. 3, 2003

(65) Prior Publication Data

US 2004/0069441 A1 Apr. 15, 2004

(30) Foreign Application Priority Data

Jun. 4, 2002 (CA) ..... 2389119

(51) Int. Cl.[7] ..... F28D 1/03

(52) U.S. Cl. ..... 165/148; 165/109.1; 165/152; 165/170; 165/183

(58) Field of Search ..... 165/148, 152, 165/170, 183

(56) References Cited

U.S. PATENT DOCUMENTS

| | | | | |
|---|---|---|---|---|
| 3,810,509 A | * | 5/1974 | Kun | 165/148 |
| 3,818,984 A | | 6/1974 | Nakamura et al. | |
| 4,011,905 A | * | 3/1977 | Millard | 165/175 |
| 4,219,079 A | | 8/1980 | Sumitomo | |
| 4,235,285 A | | 11/1980 | Johnson et al. | |
| 4,253,520 A | | 3/1981 | Friedericy et al. | |
| 4,448,241 A | | 5/1984 | Andres et al. | |
| 4,787,442 A | * | 11/1988 | Esformes | 165/151 |
| 4,805,693 A | | 2/1989 | Flessate | |
| 4,932,469 A | | 6/1990 | Beatenbough | |
| 5,025,641 A | | 6/1991 | Broadhurst | |
| 5,209,285 A | | 5/1993 | Joshi | |
| 5,369,883 A | | 12/1994 | So et al. | |
| 5,375,328 A | * | 12/1994 | De' Longhi | 29/890.039 |
| 5,462,113 A | | 10/1995 | Wand | |
| 5,689,881 A | | 11/1997 | Kato | |
| 5,692,559 A | | 12/1997 | Cheong | |
| 5,799,727 A | | 9/1998 | Liu | |
| 5,964,282 A | * | 10/1999 | Seiler et al. | 165/153 |
| 6,035,928 A | | 3/2000 | Ruppel et al. | |
| 6,109,217 A | | 8/2000 | Hedlund et al. | |
| 6,164,371 A | | 12/2000 | Bertilsson et al. | |
| 6,247,528 B1 | | 6/2001 | Blomgren et al. | |
| 6,305,466 B1 | | 10/2001 | Andersson et al. | |
| 6,478,080 B2 | * | 11/2002 | Pinto | 165/153 |

FOREIGN PATENT DOCUMENTS

| | | |
|---|---|---|
| EP | 0 384 316 | 8/1990 |
| EP | 1 136 667 A2 | 9/2001 |
| EP | 1 136 667 A3 | 4/2004 |
| GB | 1 424 689 | 2/1976 |

OTHER PUBLICATIONS

Martin Fiebig and Yuwen Chen: Heat Transfer Enhancement by Wing–Type Longitudinal Vortex Generators and Their Application to Finned Oval Tube Heat Exchanger Element, from P.79–105 of S. Kakac et al, Heat Transfer Enhancement of Heat Exchangers, Kluwer Academic Publishers, 1999.

U.S. Appl. No. 10/692,165, entitled "Lateral Plate Surface Cooled Heat Exchanger" filed Oct. 23, 2003.

* cited by examiner

*Primary Examiner*—Allen J. Flanigan
(74) *Attorney, Agent, or Firm*—Ridout & Maybee LLP

(57) ABSTRACT

A stacked plate heat exchanger including a plurality of stacked plate pairs, each plate pair including first and second plates having elongate central portions surrounded by sealably joined edge portions with an elongate fluid passage defined between the central portions. Each plate pair has spaced apart inlet and outlet openings in flow communication with the fluid passage, at least some of the plate pairs having a substantially planar air-side fin plate extending peripherally outward from the joined edge portions, the fin plates of the stacked plate pairs being spaced apart and substantially parallel to each other. The fluid passage may be arranged at an angle relative to air flow direction.

23 Claims, 9 Drawing Sheets

LATERAL PLATE FINNED HEAT EXCHANGER

This application claims priority to Canadian Patent Application No. 2,389,119 filed Jun. 4, 2002.

BACKGROUND OF THE INVENTION

This invention relates to heat exchangers, and in particular to heat exchangers made up of stacked plate pairs defining flow passages therebetween.

As well known in the art, vehicle fuel systems, for example those used in diesel passenger vehicles, often require a fuel to air cooler to cool excess fuel that is returned to the fuel tank from the fuel system. Due to limited space and high ambient temperatures, it is generally not practical to locate a fuel cooler in the engine compartment of a vehicle. Instead, it is often possible to locate the fuel cooler in an external location under the body of the vehicle. For example in a passenger vehicle, the fuel cooler may be located under the floor pan.

Generally, there is very limited space to put an underbody mounted cooler in. For example, in a passenger vehicle, the entire available space for an under-the-floor-pan cooler may be a height of about 35 mm, a length of 1–2 meters and a width of about 120 mm. Thus, it is important for an underbody cooler to be compact and have high heat exchange efficiency. Additionally, as an underbody cooler is exposed to debris and other objects, it must be very durable.

Current under-body fuel coolers generally fall into two categories, namely serpentine tube on plate coolers and extrusion type coolers. Serpentine tube on plate coolers consist of a serpentine tube bonded (brazed) to an aluminum plate. The plate may have lanced louvers, which serve to interrupt the air flow boundary layer. Extrusion type coolers include an aluminum finned-portion that is co-extruded with an adjacent flow channel portion. After extrusion, the flow channel portion is closed off at opposite ends and inlet and outlet fittings provided. Underbody mounted fuel coolers typically have low fuel mass flow velocities and speed dependent air mass flows, and are—in terms of heat transfer—typically "airside limited". Extrusion-type coolers typically suffer from limited air flow mixing (i.e. disrupting the airside heat transfer boundary layer). Serpentine tube on plate coolers typically suffer from limited air flow mixing and a relatively low airside heat transfer area.

In addition to extrusion-type and serpentine tube on plate coolers, an alternative form of heat exchanger is the stacked plate-pair heat exchanger as is shown, for example, in U.S. Pat. No. 5,692,559 issued Dec. 2, 1997, and assigned to the assignee of the present invention. Stacked plate pair heat exchangers are typically cost efficient to manufacture and have been widely adopted for applications such as oil coolers. However, existing stacked-plate pair heat exchangers have generally not been configured for use as under-body heat exchangers.

It is therefore desirable to provide a stacked plate pair heat exchanger that is configured for use as an underbody cooler and which provides improved air-flow mixing and heat transfer area.

SUMMARY OF THE INVENTION

According to one aspect of the invention there is provided a stacked plate heat exchanger including a plurality of stacked plate pairs, each plate pair including first and second plates having elongate central portions surrounded by sealably joined edge portions with an elongate fluid passage defined between the central portions. Each plate pair has spaced apart inlet and outlet openings in flow communication with the fluid passage, at least some of the plate pairs having a substantially planar fin plate extending peripherally outward from the joined edge portions, the fin plates of the stacked plate pairs being spaced apart and substantially parallel to each other.

According to another aspect of the invention, there is provided a stacked plate heat exchanger comprising a stack of aligned plate pairs, each plate pair including two plates having elongated central portions defining an elongate fluid passage having spaced apart inlet and outlet openings, each plate pair including an elongate fin plate extending peripherally from the fluid passage. The fin plate has elongate, parallel spaced apart first and second edges, the fluid passage longitudinally located between the spaced apart first and second edges and extending at an angle relative to the first and second edges.

BRIEF DESCRIPTION OF THE DRAWINGS

Example embodiments of the invention will now be described, by way of example, with reference to the accompanying drawings throughout which like reference numerals are used to refer to similar elements and features, in which.

DESCRIPTION OF THE EXAMPLE EMBODIMENTS

Figure 1:
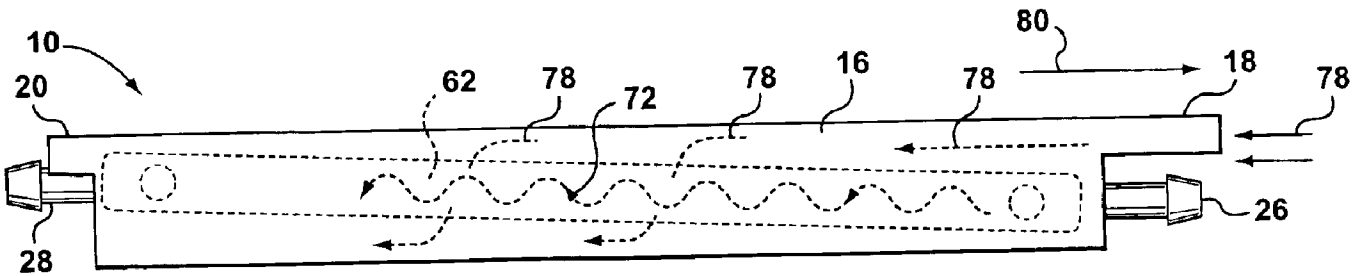
FIG. 1 is a side elevation of a stacked plate heat exchanger according to one embodiment of the invention.
Figure 2:
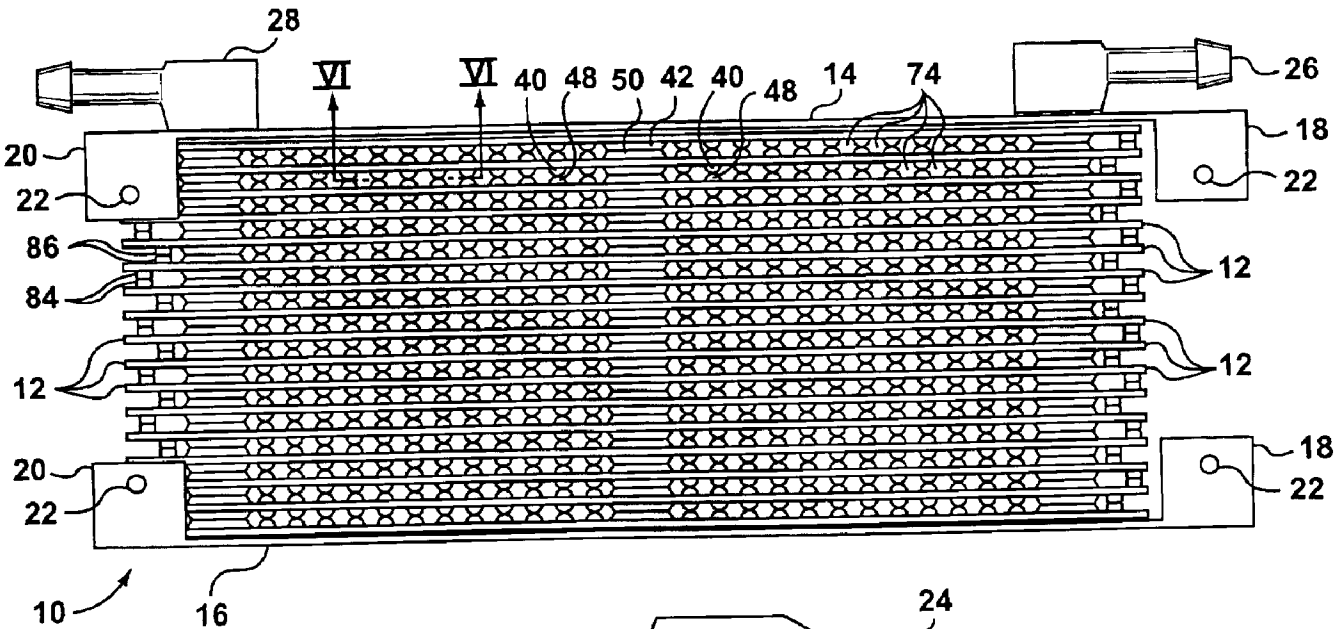
FIG. 2 is a top plan view of the heat exchanger of FIG. 1.

Referring firstly to FIGS. 1 and 2, an example embodiment of a heat exchanger according to the present invention is indicated generally by reference numeral 10. Heat exchanger 10 is formed from a plurality of stacked plate pairs 12, that are sandwiched between first and second end support plates 14, 16. The first and second end support plates 14, 16 each have front and back horizontal mounting flanges 18, 20, each of which has one or more mounting holes 22 formed there through for mounting heat exchanger 10 in a desired location. First and second end support plates are not essential to heat exchanger 10 and may be eliminated, altered or replaced with other suitable arrangements for mounting the heat exchanger 10.

Figure 3:
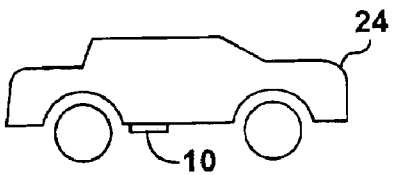
FIG. 3 is a diagrammatic view of a passenger vehicle with the heat exchanger of FIG. 1 mounted thereto.

In an automotive application, the heat exchanger 10 will typically be used as an underbody cooler. In one application, the heat exchanger may be used to cool excess fuel that is returning from the fuel system to the fuel tank, however, it could also be used in other applications to cool other types of fluids. FIG. 3 shows a diagrammatic view of heat exchanger 10 mounted under the floor pan of an automobile 24. When the heat exchanger 10 is mounted in place, inlet fitting 26 and outlet fitting 28 (see FIGS. 1 and 2) are connected to a fuel return line (not shown) in the fuel system such that the returning fuel passes through the heat exchanger 10.

Figure 4:
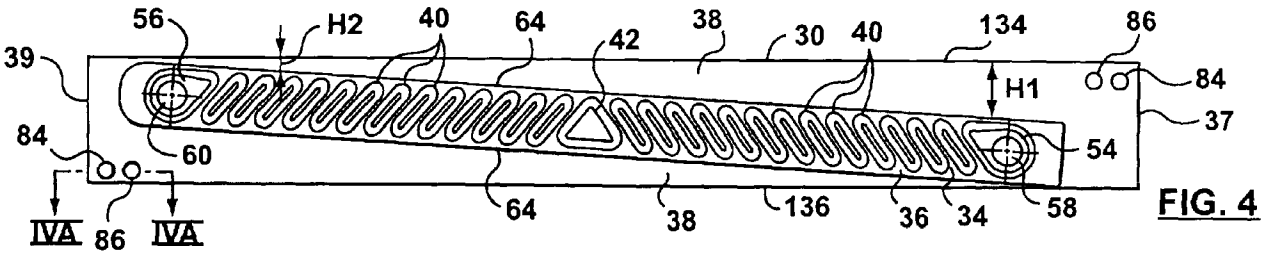
FIG. 4 is a side elevation of a first plate of each plate pair according to one embodiment of the invention and FIG. 4*a* is a partial sectional view taken along the lines IVa—IVa of FIG. 4.
Figure 5:
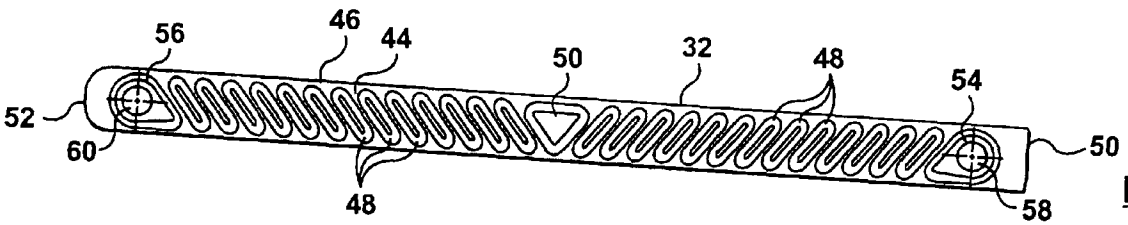
FIG. 5 is a side elevation of a second plate of each plate pair.

Referring now to FIGS. 1, 2 and 4 to 7 the construction of plate pairs 12 will now be described in greater detail. FIGS. 4 and 5 show, respectively, example embodiments of the first and second plates that make up each plate pair 12. The first plate 30 includes an elongate central planar portion 34 that is surrounded by a planar edge portion 36, which in turn is surrounded by a peripherally extending, substantially planar fin plate portion 38. A series of ribs 40 are formed along central planar portion 34. In the presently described embodiment, the ribs 40 closer the front end 37 of the first plate 30 are parallel and obliquely orientated in a first direction, and the ribs 40 closer the back end 39 of the plate 30 are parallel and obliquely orientated in a second, opposite direction, with a central triangular boss 42 being formed between the two sets of oppositely orientated ribs 40.

The second plate 32 has a configuration similar to that of first plate 30 in that it includes an elongate central planar portion 44 that is surrounded by a peripheral planar edge portion 46, with series of ribs 48 formed along central planar portion 44, however, in the presently described embodiment, the second plate 32 does not include a fin plate portion. As with first plate 30, the ribs 48 closer the front end 50 of the second plate 32 are parallel and obliquely orientated in one direction and the ribs 48 closer the back end 52 of the plate 32 are parallel and obliquely orientated in an opposite direction, with a central triangular boss 50 being formed between the two sets of oppositely orientated ribs 48.

Figure 6:
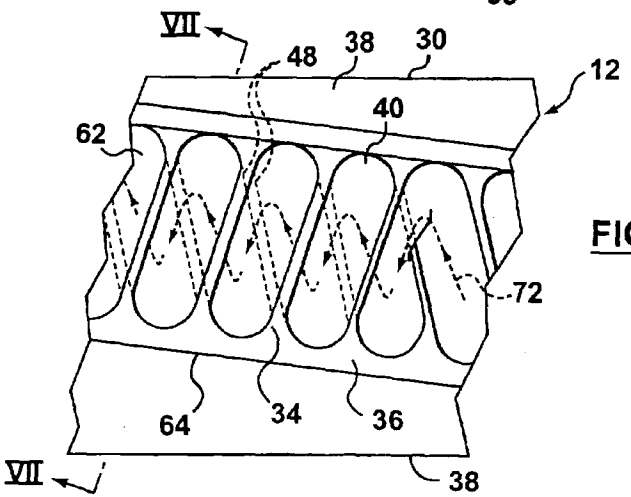
FIG. 6 is an enlarged sectional side view of a portion of a plate pair showing the crossing of ribs on mating plates, taken along the lines VI—VI of FIG. 2.
Figure 7:
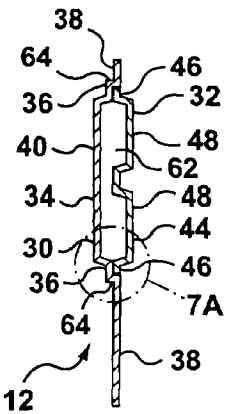
FIG. 7 is a sectional view of a plate pair taken along the lines VII—VII of FIG. 6

In FIG. 4, the first plate 30 is viewed showing its outer surface, so that ribs 40 and triangular boss 42 are coming out of the page. In FIG. 5, the second plate 32 is viewed showing its inside surface, so that the ribs 48 and boss 50 are actually going into the page. First and second plates 30 and 32 are placed together and sealably connected about edge portions 36, 46 to form a plate pair 12 (As best seen in FIGS. 6 and 7), in which a fluid passage 62 is defined between planar central portions 34, 44 of the plates 30, 32. More particularly, and as will be described in greater detail below, in the presently described embodiment overlapping ribs 40, 48 provides fluid passage 62 that extends from an inlet end to an outlet end of the plate pair 12.

In an example embodiment the plates 30, 32 are stamped from braze-clad aluminum or aluminum alloy, however other suitable metallic and non-metallic materials formed using various methods such as stamping, roll-forming, etc. could be used as desired for specific heat exchanger applications.

Figure 7A:
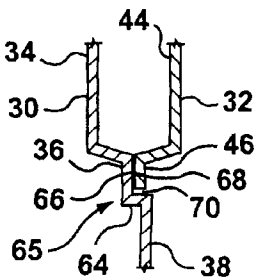
FIG. 7A is an enlarged portion of a circled part of FIG. 7.

In one example embodiment, the second plate 32 is nested within a pocket formed in first plate 30, which provides a novel self-locating and self-aligning function during assembly of each plate pair 12. As best seen in FIGS. 7 and 7A, the planar edge portions 36 and 46 each include facing planar surfaces 66, 68 that abut. The planar edge portion 36 of the first plate 30 is slightly larger than the edge portion 46 of the second plate, and terminates in a peripheral locating wall 64 that extends laterally from the planar edge portion 36. The planar fin 38 extends outward from the locating wall 64 in a plane that is parallel to the plane of edge portion 36, such that the locating wall 64 provides a step between the edge portion 36 and the planar fin 38. The locating wall 64 and edge portion 36 thus define a pocket, indicated generally by reference numeral 65 in FIG. 7A, within which the edge 46 of the second plate 32 is nested. As noted above, preferably, the first plate edge portion 36 is slightly larger than the second plate edge portion 46, with the result that locating wall 64 will be spaced slightly apart from second plate edge 46, allowing brazing material to provide a secure joint in the space 70. Additionally, space 70 permits the second plate 32 to be compressed somewhat against first plate 30 during assembly of the heat exchanger plate pair stack such that the plate 32 acts as a leaf spring with the result that improved sealing reliability is possible during brazing of the plate pair stack. As a result of the nesting plate pair structure, the force of compression on the plate pairs by the assembly fixture is transmitted equally through the entire plate stack, providing a self-fixturing mechanism that holds the plates in place during brazing. Pocket 65 facilitates relative positioning of the plates 30, 32 during heat exchanger assembly and maintains the relative positions of the first and second plates during heat exchanger assembly and brazing, providing the self-locating and self-aligning features noted above.

Referring again to FIGS. 4 and 5, first and second plates 30, 32 are also formed with end bosses 54, 56 which define respective inlet openings 58 and outlet openings 60. When plate pairs 12 are stacked, all of the inlet openings 58 are in registration and communicate with inlet fitting 26, and all of the outlet openings 60 are in registration and communicate with outlet fitting 28. In this way, all of the end bosses 54 form an inlet manifold and all of the end bosses 56 form an outlet manifold so that fluid flows in parallel through all of the plate pairs 12. However, it will be appreciated that some of the inlet openings 58 and some of the outlet openings 60 could be selectively closed or omitted, as will be appreciated by those skilled in the art, so that fluid could be made to flow in series through each of the plate pairs 12, or in some series/parallel multi-pass combination. In a multi-pass configuration, inlet and outlet fittings may be connected to the same manifold.

As shown in FIG. 5, the opposite ends 50, 52 of the second plate 32 may conveniently be shaped differently (end 50 having square corners and end 52 having rounded corners). The ends of the pocket of first plate 30 in which the second plate is received have corresponding shapes, such that the edge of the second plate can only be received within the pocket when properly orientated, in order to prevent incorrect assembly of the plate pairs.

FIG. 6 shows a portion of a plate pair 12, with the second plate 32 being located behind the first plate 30 and thus hidden from view. The ribs 48 of the second plate 32 are shown in phantom with dashed lines. The second plate ribs 48 cooperate with the first plate ribs 40 to define fluid passage 62 having a zigzag pattern, indicated by phantom arrows 72, along the length of the plate pair 12. With reference to FIG. 1, the fluid passage 62 of a plate pair 12 is generally indicated, along with the zigzag path 72 that defines the fluid path. The use of cooperating ribs formed on the plates of a plate pair to provide fuel mixing along a fluid passage is well known, as is apparent from previously mentioned U.S. Pat. No. 5,692,559, and a number of different criss-cross rib configurations are possible other that shown in FIGS. 4 to 6 of the present application. By way of example, each rib could communicate with three ribs on the opposing plate instead of just two as illustrated. Further, in some embodiments, the orientation of the ribs may not change at the plate pair mid point, but rather all ribs the entire length of the plate may be parallel. Thus, the exact criss-cross rib pattern used in the plate pairs of the heat exchanger 10 need not be as illustrated, and suitable alternative arrangements could be used.

When the plate pairs 12 are arranged in parallel in a stack, the ribs from adjacent plate pairs are brazed in contact with each other, providing strength and rigidity to the stack of plate pairs 12. Abutting ribs 40, 48 between adjacent plate pairs 12 are shown on the first two plate pairs 12 at the top of FIG. 2. Although not shown in detail in FIG. 2, it will be appreciated that the abutting ribs between adjacent plate pairs continues throughout the entire stack of plate pairs. Air ducts or passages 74 are formed between the abutting ribs 40, 48 of adjacent plate pairs such that air can flow between adjacent plate pairs thus facilitating heat exchange between the air and with the fluid flowing in the fluid passages 62 defined within each plate pair 12. If identical plate pairs 12 are used throughout the plate pair stack, then the contacts between abutting ribs of adjacent plate pairs will be non-continuous, and, in the illustrated example each rib will contact two ribs on an adjacent plate. Alternatively, in a further example embodiment of the invention, the pattern on adjacent plate pairs is reversed such that each rib contacts the rib of an adjacent plate along the entire length of the rib. In one example embodiment, this alternative embodiment is achieved by rotating alternative plate pairs end for end one hundred and eighty degrees.

Figure 8:
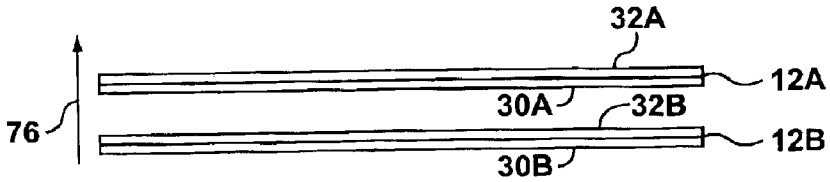
FIG. 8 shows a simplified top plan view of two adjacent plate pairs.
Figure 9:
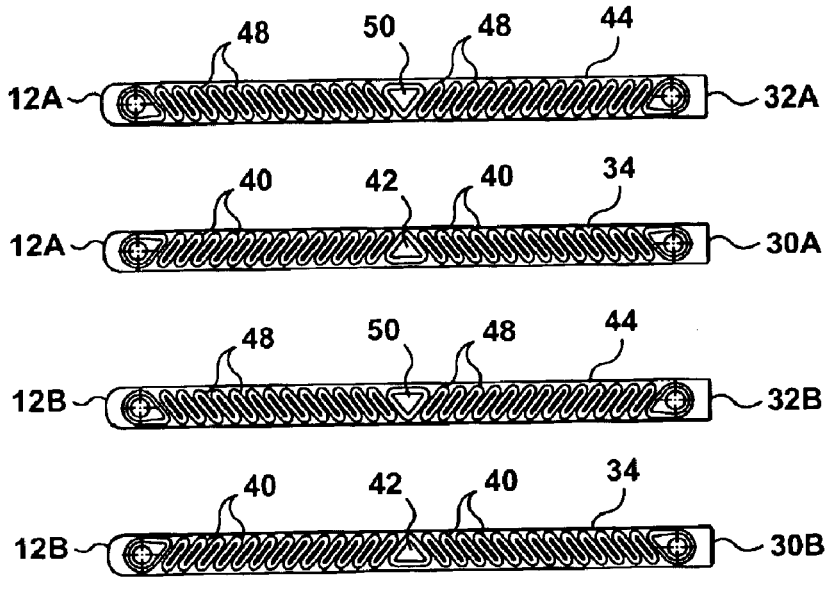
FIGS. 9 and 10 shows simplified side views of each of the plates of FIG. 8 demonstrating two alternative embodiments of the invention.
Figure 10:
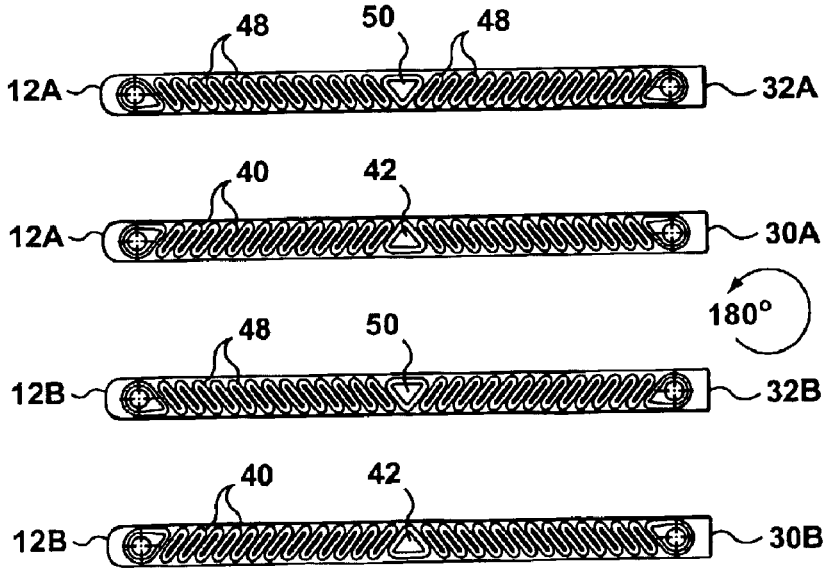

By way of further explanation, reference is made to FIGS. 8 to 10. FIG. 8 shows a simplified top plan view of two adjacent plate pairs 12A and 12B, formed from plates 32A, 30A and 32B, 30B, respectively. Although not shown in FIG. 8, contacting ribs 48, 40 and air passages 74 are located between plate pairs 12A and 12B. FIG. 9 shows simplified side views of each of the plates taken from a viewing direction indicated by arrow 76 showing the orientation of ribs 40 and 48 in an embodiment of the invention in which each of the plate pairs are identically orientated. FIG. 10 is similar to FIG. 9, except that it shows an embodiment in which the plates in adjacent pairs are rotated 180 degrees such that rib orientation is reversed between the adjacent plate pairs. In the embodiment of FIG. 9, the ribs 40 of plate 30A (such ribs 40 extend outward from the page as illustrated) abut against the ribs 48 of plate 32B (such ribs 48 extend inward into the page as illustrated). The ribs abut in a non-continuous manner, defining a series of air passages between the plate pairs 12A and 12B. In the embodiment of FIG. 10, the ribs 40 of plate 30A also abut against the ribs 48 of plate 32B. However, unlike in FIG. 9, the abutting ribs of the adjacent plate pairs are similarly orientated such that each rib 40 abuts continuously along its length with a corresponding rib 48. The embodiment of FIG. 10 provides larger direct air-flow passages between the plate pairs than the embodiment of FIG. 9.

The peripherally extending fin plate portion 38 of each plate pair 12 provides an increased heat exchange surface area over previous plate pair heat exchangers not having such a fin 38. The fin 38 extends "air-side" from the opposed central plate portions 34, 44 of the plates between which the fluid passage 62 is defined. With reference to FIG. 1, in an example embodiment when the heat exchanger is moving in a direction indicated by arrow 80, air flows into and through the parallel fins 38 and through the air passages 74 between the ribbed plate portions, as indicated by air flow arrows 78, drawing heat away from the fluid passing through fluid passages 62. In the presently described embodiment, the heat exchanger plate pairs 12 are configured such the ribbed portions there of are angled relative to the direction of travel. In particular, as can be appreciated from FIG. 1, the plate pairs 12 are arranged such that the fluid passages 62 have a leading end that is lower than a trailing end thereof. As can be seen in FIG. 4, in an example embodiment, the rectangular fin plate portion 38 is sized to take advantage of the angled configuration, the fin plate portion 38 extending a greater height H1 from a forward end of the ribbed central portion 34 of the first plate 30 and a lesser height H2 from a rearward end of central portion 34. In other words, as can be appreciated from FIG. 4, the fin plate portion 38 has longitudinal upper and lower peripheral edges 134, 136 that extend length-wise between ends 37, 39. The portion of the plate pair (in particular the elongate central portions 34, 44) that define the fluid passage 62 extends the majority of the distance between ends 37,39, but at an angle relative to the edges of the fin plate, rather than parallel to the fin plate edges.

Figure 4A:
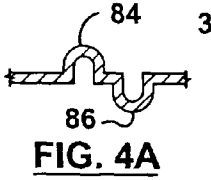

With reference again to FIG. 4, protrusions or dimples 84 and 86 may conveniently be formed in the fin plate portion 38 of the first plate 30 for the purpose of strengthening the extending fin portions and also to disrupt the boundary layer of air passing between the fins. In the illustrated embodiment, a first pair of dimples 84, 86 are provided near the lower back end 39 of the plate 30. As can be seen in FIG. 4A, the dimples 84 and 86 extend in opposite directions. A second pair of dimples 84, 86 are provided near the upper front end 37 of the plate 30. The dimples 84, 86 at the front end 37 extend in directions that are opposite of their counterparts at back end 39 such that when the plate 30 is rotated by 180 degrees in alternating plate pairs 12, the dimples 84, 86 of one plate pair 12 will abut against and be brazed to the dimples 84, 86, respectively, of an adjacent plate pair, as can be seen in FIG. 2.

Figure 11:
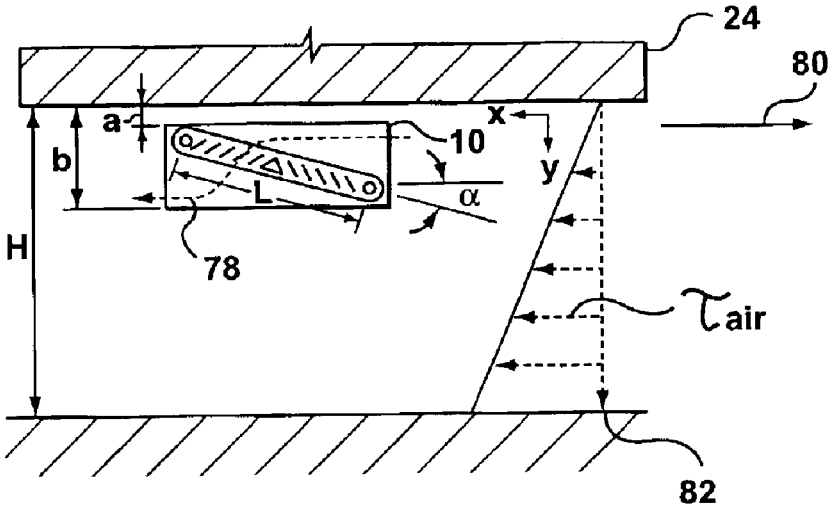
FIG. 11 is a further diagrammatic view of the heat exchanger located under the body of a vehicle.

With reference to FIG. 11, the angled orientation of the plate pairs will be discussed in greater detail. FIG. 11 shows a diagrammatic view of heat exchanger 10 located under the body of vehicle 24. The height H represents the distance from ground 82 to the underside of vehicle 24, and the height a is a specified clearance between the underbody and the heat exchanger 10. The height H-b is the clearance required between ground and any part of the vehicle, with b-a being the available height for heat exchanger 10. As indicated in FIG. 11, the air velocity profile is approximately linear in the y direction from the underbody to the ground. For optimum air-side heat transfer, it is desired to place the cooler in the fastest flowing air. The inclination angle $\alpha$ refers to the angle between the general direction of fluid passages 62 relative to the horizontal. For maximum air flow through the cooler, $\alpha$=90 degrees, however such angle is not possible for any heat exchanger in which the length L>b-a. The inclination angle $\alpha$ can be greater or less than 0, with a positive angle occurring when the leading edge of the flow passages of the heat exchanger is higher than the trailing edge, and a negative angle occurring when the trailing edge of the flow passages of the heat exchanger is higher than the leading edge (as is shown in FIG. 11). A negative $\alpha$ can create a high pressure air zone between the heat exchanger and the car underbody due to the narrowing passage there between, forcing air through the trailing half of the heat exchanger as indicated by arrow 78 in FIG. 11. In some applications, the heat exchanger could be orientated leading edge up with a positive $\alpha$. The angle $\alpha$ is preferably selected to maximize air flow through the heat exchanger dependent on the dimensional restraints that are placed on the heat exchanger by its intended use. The use of plate pairs having fin plates that are angled relative to the fluid passages therethrough allows the size of the fin plates to be relatively large relative to the space permitted for the heat exchanger package.

Figure 12:
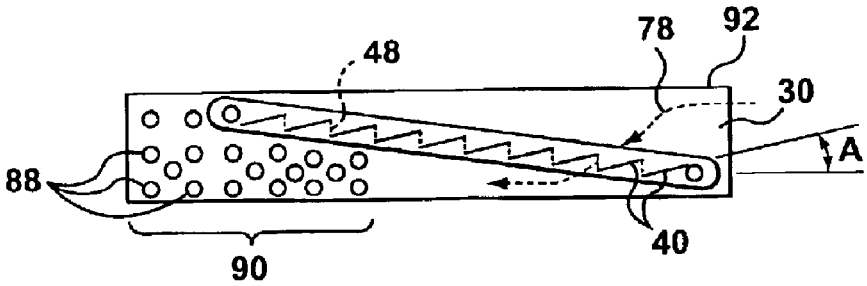
FIG. 12 is a simplified side view of a plate pair in accordance with a further embodiment of the invention.

FIG. 12 shows a further plate pair 92 for use in an alternative embodiment of heat exchanger 10. The plate pair 92 is substantially identical to plate pair 12, except that ribs 40 in first plate 30 are all parallel along the entire length of plate 30, without a change in orientation at the mid-point of the plate. Similarly, ribs 48 (shown in phantom) of second plate 32 are all parallel. The angle A of ribs 40 relative to the horizontal is relatively small so that the ribs 40 are close to being parallel with the incoming air flow direction 78. Such configuration may provide improved heat transfer in some applications. The plate pair 92 may also include a trailing fin plate portion 90 on which is formed a plurality of dimples 88. In the view of FIG. 12, some dimples 88 may extend into the page, and some may protrude from the page. The dimples 88 serve to further break up the air flow boundary layer of air passing through the heat exchanger.

Figure 13:
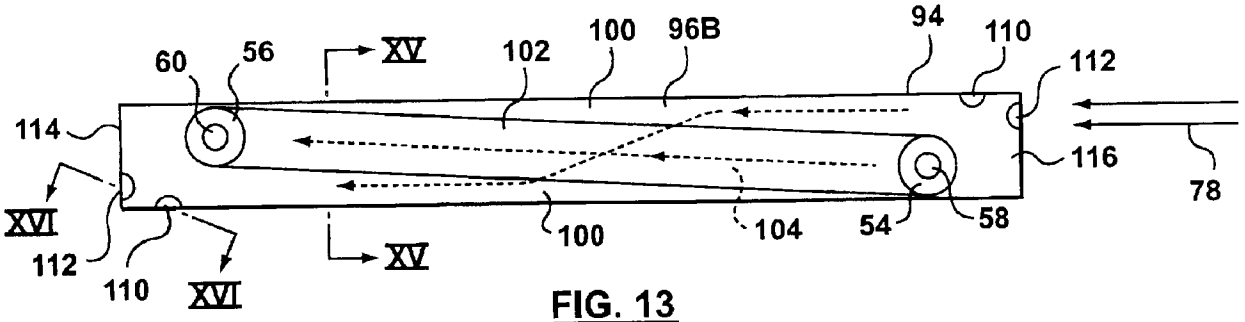
FIG. 13 is a side view of a further plate pair configuration in accordance with another embodiment of the invention.
Figure 14:
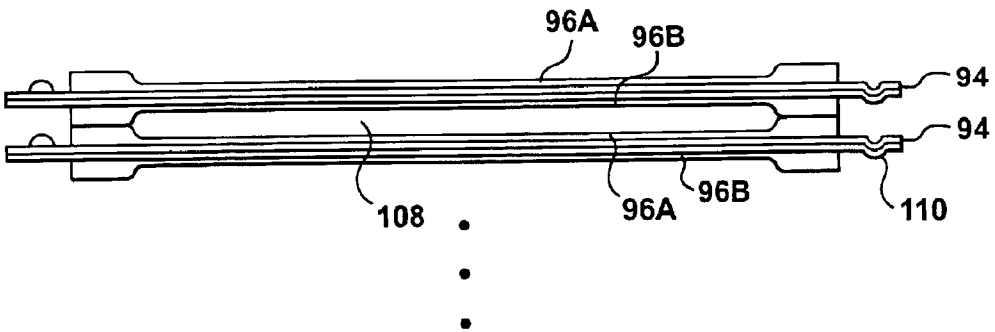
FIG. 14 shows two of the plate pairs of FIG. 13 joined together.

FIGS. 13 to 16 illustrate a further plate pair 94 for use in yet another embodiment of heat exchanger 10. The plate pair 94 is similar to plate pair 12, with the exception of differences that will be appreciated from the following description. The plate pair 94 is conveniently formed from two similar opposed plates 96A and 96B that may be mirror images of each other. Each plate 96A and 96B has peripheral edge portions 100, the edge portions 100 of two plates joined together to form plate pair 94. Each plate 96A and 96B also has a central planar portion 102, the central portions of the joined plates in each plate pair 94 being spaced apart to define a fluid passage 104 between the plates. The central planar portions 102 are not ribbed as in plate pair 12, but rather an elongate turbulizer 106 is located in the fluid passage 104 for augmenting fluid flow therethrough (in some applications, the channel 104 could be clear with no turbulizer located therein). The peripheral edge portions 100 extend a relatively large distance from the central planar portions 102, thus providing an integrally formed air-side fin surface portion for plate pair 94. As with plates of plate pair 12, the plates 96 are formed with end bosses 54, 56 that define respective inlet and outlet openings 58, 60. FIG. 14 shows two plate pairs 94 arranged side-by-side as part of a plate pair stack of a heat exchanger, with an air passage 108 defined between the plate pairs 94.

Figure 15:
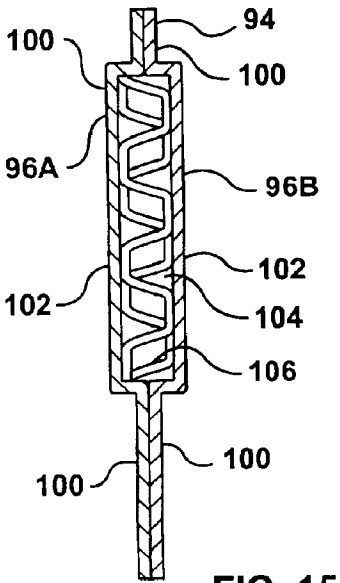
FIG. 15 is a sectional view taken along the lines XV—XV of FIG. 13.
Figure 16:
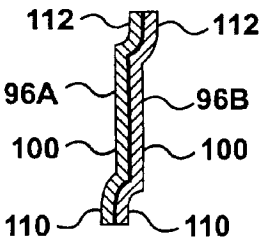
FIG. 16 is a sectional view taken along the lines XVI—XVI of FIG. 13.

In order to facilitate assembly of the plate pairs 94, locating protrusions or half dimples 110, 112 may be provided along the perimeter edge of the plates 96A, 96B to assist in lining up the plates in a plate pair. As shown in FIG. 13, at air-flow downstream end 78, the half dimple 112 projects outward from the page, and the half dimple 110 projects into the page, and conversely at air-flow upstream end 116, the half dimple 112 projects into the page, and the half dimple 110 projects out of the page. Plates 96A, 96B are mated together as shown in FIG. 15 with locating dimples aligned and nested as shown in FIG. 16.

Figure 17:
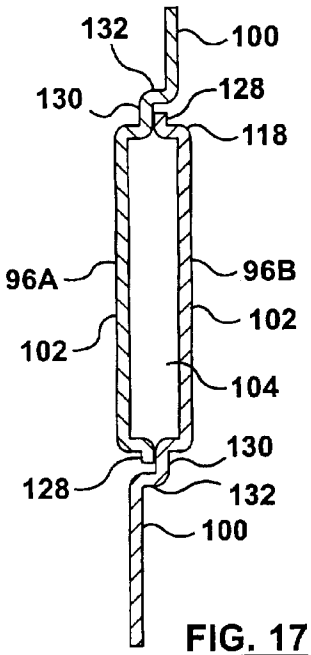
FIG. 17 is a sectional view of a further possible plate pair configuration.

FIG. 17 shows yet another possible plate pair configuration for plate pair 94. In the embodiment of FIG. 17, the upper fin plate portion 100 extends only from one plate 96A of the plate pair, and the lower fin plate portion 100 extends only from the other plate 96B of the plate pair 94. In the embodiment of FIG. 17, the edge portions 128 and 130 of opposed plates 96A, 96B are joined to form plate pair 128. In each plate 96A, 96B, the fin plate portion 100 extends peripherally from the edge portion 130, and in particular is joined to the edge portion 130 by a locating wall 132 that is perpendicular to the edge portion 130 and fin plate portion 100. The locating wall 132 and edge portion 130 of one plate 96A, 96B form a notch for receiving the edge portion 128 of the other plate of the plate pair 128, and vice versa.

In some embodiments, ribs (not shown) that extend only partially into fluid passage 104 may be provided on central portions 102 in order to augment fluid flow through fluid passage 104.

Figure 18:
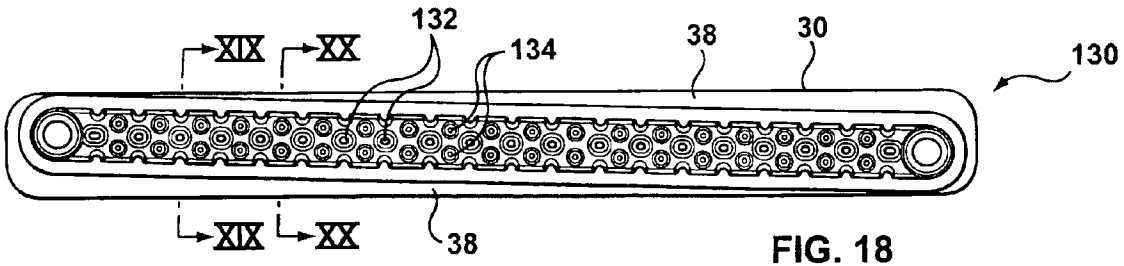
FIG. 18 is a side view of still a further plate pair configuration in accordance with embodiments of the present invention.
Figure 20:
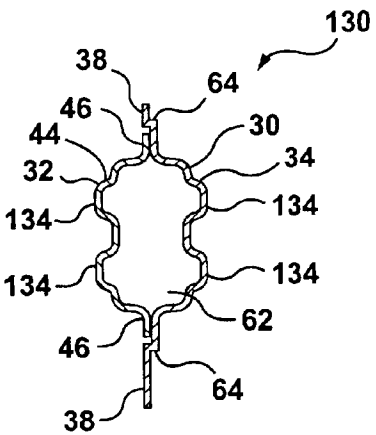
FIG. 20 is a sectional view taken along lines XX—XX of FIG. 20.
Figure 19:
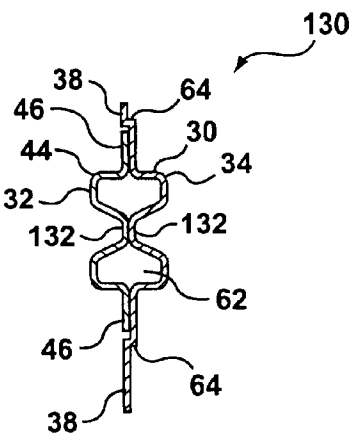
FIG. 19 is a sectional view taken along the lines XIX—XIX of FIG. 18.

FIGS. 18, 19 and 20 show another possible plate pair configuration, indicated generally by reference 130, for use in heat exchanger 10. The plate pair 130 is substantially similar to plate pair 12, with one notable difference being that dimples 132, 134 (rather than ribs) are formed in the spaced apart central planar portions 34, 44 of plates 30, 32 to augment flow through fluid passage 62. In the illustrated embodiment a central row of dimples 132 extend inward into the fluid passage 62, with the inner ends of opposing dimples 132 joining together. Two parallel rows of outwardly (i.e. air-side) extending dimples 134 are provided along the fluid passage 62. Preferably, the extending dimples 134 from one plate pair 130 will contact the extending dimples 134 from an adjacent plate pair, thus providing rigidity to the core stack as well as providing flow augmentation means for breaking the boundary layer of air flowing between the plate pairs. As with plate pair 12, the plate pair 130 is configured such that the fluid passage defined between central planar portions 34, 44 is angled relative to the rectangular fin portion 38 of the plate pair.

Figure 21:
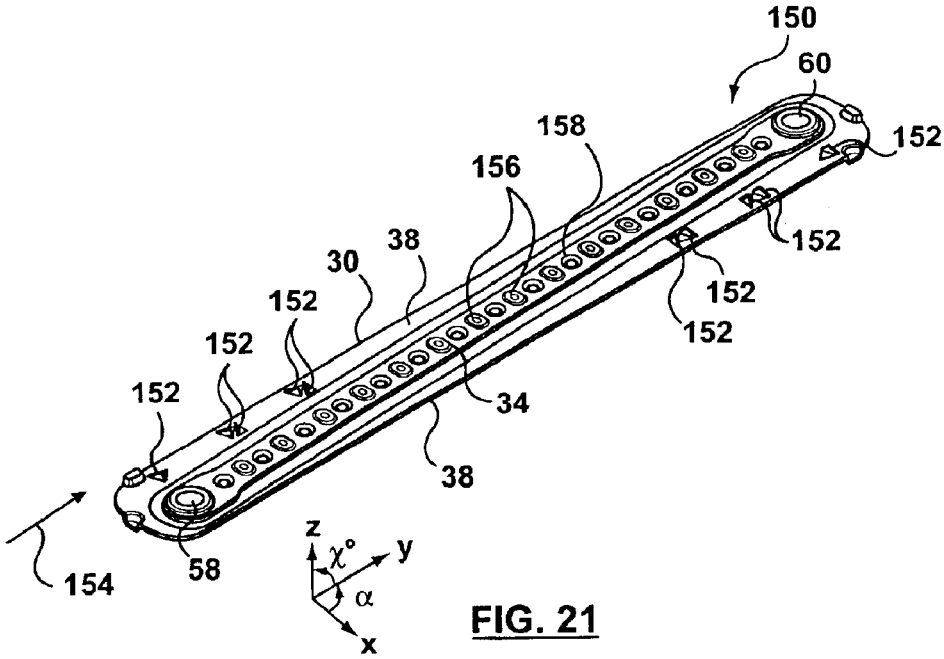
FIG. 21 is a perspective view of a further plate pair configuration according to embodiments of the invention.
Figure 22:
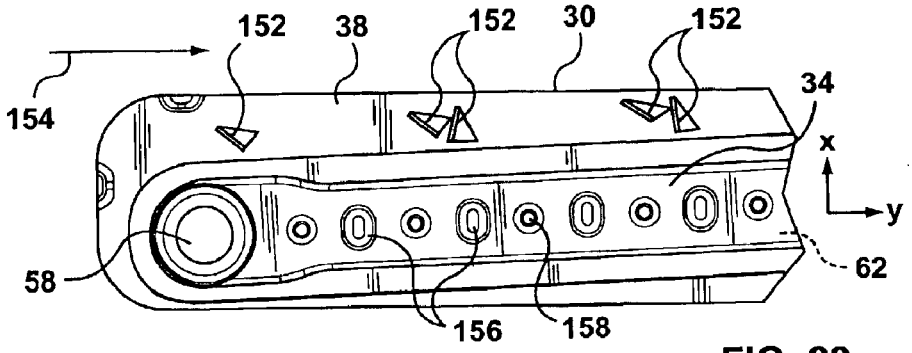
FIG. 22 is a partial side view of the plate pair of FIG. 21.
Figure 23:
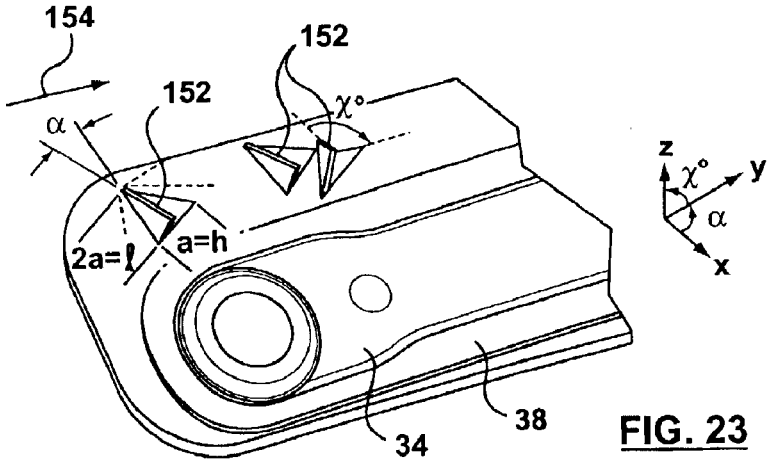
FIG. 23 is an enlarged partial perspective view of the plate pair of FIG. 21.

FIGS. 21 to 23 show another possible plate pair configuration, indicated generally by 150, for use in heat exchanger 10. The plate pair 150 is substantially similar in construction to plate pairs 12 and 130, but for differences that will be apparent from the Figures and the present description. In plate pair 150, delta shaped winglets 152 are formed along leading upper and trailing lower parts of the air side fin plate portion 38 of the plate 30 to provide enhanced air-side heat transfer by inducing swirl and boundary layer separation and recreation along the length of the fin plate portion. In some embodiments, winglets 152 are selectively located only near the leading end of the heat exchanger; and in some embodiments winglets 152 are selectively located only near the trailing end of the heat exchanger, depending on the desired heat exchanger performance. The presence of winglets 152 causes air swirl to be induced in the air flow downstream therefrom, resulting in downwash air flow impacting on the fin plate portion that can improve local air side heat transfer. In one example winglet configuration as shown in FIG. 22, a leading winglet 152 (relative to the direction of air flow as indicated by arrow 154 in FIG. 22) located on an upper portion of fin plate portion 38 is followed by two spaced apart pairs of trailing winglets 152. In each winglet pair, the trailing winglet is closely placed to the leading winglet and at a relative angle to the leading winglet, such that the two winglets act in complimentary fashion for inducing air-side swirl. The delta (triangular) shaped winglets 152 are, in the example embodiment, lanced along two side edges from the fin plate portion 38 and folded out from the plate. In an example embodiment, as best seen in FIG. 23, each winglet 152 has an aspect ratio of l/h=2; an angle of attack of $\alpha$=45° to oncoming air flow (in the X-Y plane as shown in FIGS. 21–23); and is folded out from the fin plate portion 38 at X°=90° (in the x-z plane) to project a maximum surface area into the oncoming air flow. Within each winglet pair, the winglet spacing is equal to h. Other winglet configurations and shapes are used in various embodiments.

In the illustrated embodiment of FIGS. 21–23, the central planar portions of the plates of heat exchanger plate pair 150 have dimples 156, 158 formed therein. Dimples 156 protrude outward from the plates, such that the dimples 156 from back-to-back plates of adjacent plate pairs contact each other on the air-side passages between adjacent plate pairs. The dimples 158 extend inward into the internal flow channels 62 defined within the plate pair, turbulizing fluid flow therein and providing structural strength. In plate pair 150, the flow channel 62 is wider near the inlet and outlet openings 58, 60, and narrower in the region between the openings, to increase the relative velocity of fluid through the flow channel 62.

Figure 24:
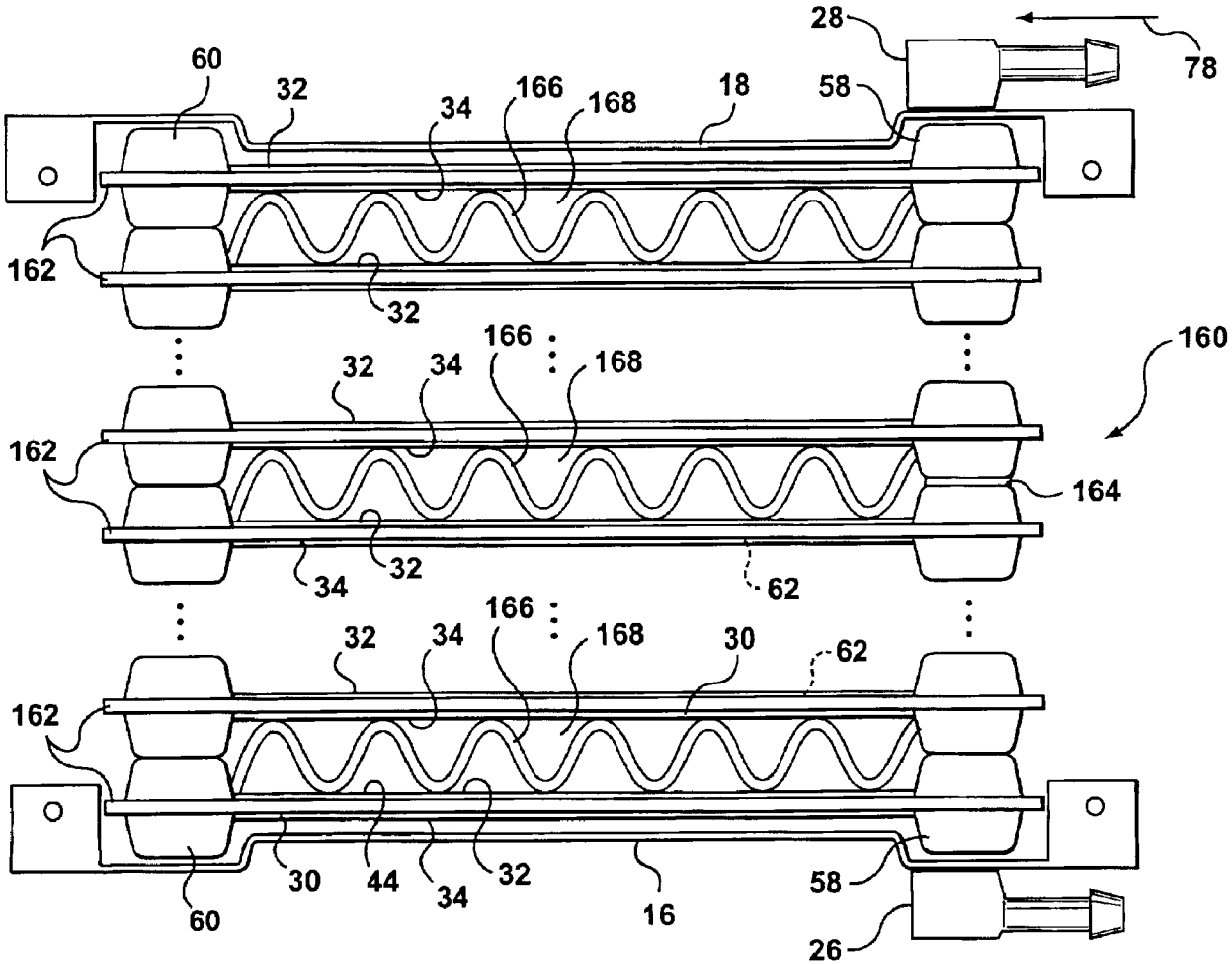
FIG. 24 is a top plan view of a heat exchanger according to yet another embodiment of the invention.
Figure 25:
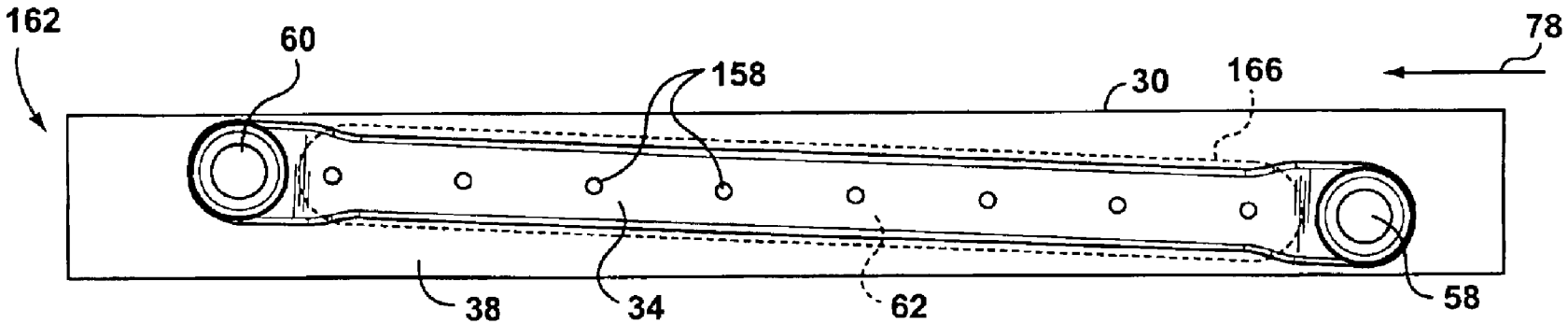
FIG. 25 is a side view of a plate pair of the heat exchanger of FIG. 24.

FIG. 24 shows a further heat exchanger 160 according to yet another example embodiment, and FIG. 25 shows a plate pair of heat exchanger 160. Heat exchanger 160 is substantially similar in construction to heat exchanger 10, but for the differences that will be apparent from the Figures and the present description. In heat exchanger 160, external fin plates 166, which in the illustrated embodiment are corrugated fin plates, are located in the air passages 168 between back-to-back plates 30, 32 of adjacent plate pairs 162. In plate pairs 162, the central planar portions 34, 44 of plates 30, 32, respectively, are formed with spaced apart dimples 158 that extend inward into the fluid passage 62. The fin plates 166 are secured between the central planar portions 34, 44 of the plates 30, 32 of adjacent plate pairs 162 and the central planar portion 44. Dashed line 166 in FIG. 25 illustrates the location of a fin plate 166 relative to the flow passage 62. In an example embodiment, the fin plate 166 is sized to correspond in height and length substantially to the size of central planar portions 34, 44 (and hence flow passage 62). Fin plate 166 can provide air-side heat exchanger surface area and structural rigidity to the heat exchanger 160. The extended fin plate portion 38 provides protection for the fin plate 166 from debris. Fin plate 166 can be replaced with other turbulizing structures, including, for example, an expanded metal turbulizer plate.

In heat exchanger 160, a flow circuiting insert 164 is provided to divide the manifold at the leading end of the heat exchanger 160 into two halves, with inlet and outlet fittings 26, 28 both being located at a leading end of the heat exchanger. Brackets 16 and 18 seal off the openings 60 at the trailing end in the plates 30 and 32 at the outer sides of the heat exchanger 160.

It will be apparent to those skilled in the art that in light of the foregoing disclosure, many alterations and modifications are possible in the practice of this invention without departing from the spirit or scope thereof. Accordingly, the scope of the invention is to be construed in accordance with the substance defined in the following claims.

What is claimed is:

1. A stacked plate heat exchanger comprising:

a plurality of stacked plate pairs, each plate pair including first and second plates having elongate central portions surrounded by sealably joined edge portions with an elongate fluid passage defined between the central portions; each plate pair having spaced apart inlet and outlet openings in flow communication with the fluid passage, at least some of the plate pairs having a substantially planar fin plate extending peripherally outward from the joined edge portions, the fin plates of the stacked plate pairs being spaced apart and substantially parallel to each other;

wherein for each of the at least some plate pairs, the planar fin plate has a first fin end and a second fin end and first and second spaced apart elongate edges extending there between, the fluid passage being located between the spaced apart edges and having a first fluid passage end located closer to the first fin end than the second fin end and a second fluid passage end located closer to the second fin end than the first fin end, the fluid passage being orientated at an angle relative to the first elongate edge of the fin plate with one of said first and second fluid passage ends being located closer to the first elongate edge than the other of said first and second fluid passage ends, the fluid passages of the plate pairs all being orientated in a common direction.

2. The heat exchanger of claim 1 wherein the heat exchanger is adapted to be mounted under the body of a vehicle, the first fin edge of the fin plate being an upper edge of the fin plate.

3. The heat exchanger of claim 1 wherein external passages are defined between back-to-back central portions of the plates of adjacent plate pairs, and the fin plates define external passages therebetween that communicate with respective external passages between the central portions.

4. The heat exchanger of claim 3, wherein a fluid turbulizing structure is located in the external passages between the central portions.

5. The heat exchanger of claim 4 wherein the fluid turbulizing structure is a corrugated fin plate.

6. The heat exchanger of claim 1 wherein for the at least some plate pairs having fin plates, the fin plate of each plate pair is formed integrally with only one of the first and second plates thereof.

7. The heat exchanger of claim 1 wherein for each of the at least some plate pairs having fin plates, the fin plate is formed from a first fin plate portion formed integrally with the first plate and a second fin plate potion formed integrally with the second plate, the first and second fin plates being laminated together.

8. The heat exchanger of claim 7 wherein cooperating locating protrusions are provided on the first and second plates for aligning the plates during assembly.

9. The heat exchanger of claim 1 wherein winglets are formed on a length of the fin plates for inducing downwash air flow onto the fin plates.

10. The heat exchanger of claim 9 wherein the winglets have a protruding substantially triangle shape.

11. The heat exchanger of claim 9 wherein at least some of the winglets are arranged in complimentary pairs.

12. The heat exchanger of claim 1 wherein the central portions are substantially planar and have a first plurality of obliquely orientated, parallel ribs formed thereon, the ribs of the first and second plates in each plate pair cooperating to form at least a portion of the fluid passage.

13. The heat exchanger of claim 12 wherein in back-to-back plates of adjacent plate pairs each rib on one plate contacts at least two ribs on an adjacent plate of the back-to-back plates.

14. A stacked plate heat exchanger comprising:

a plurality of stacked plate pairs, each plate pair including first and second plates having elongate central portions surrounded by sealably joined edge portions with an elongate fluid passage defined between the central portions; each plate pair having spaced apart inlet and outlet openings in flow communication with the fluid passage, at least some of the plate pairs having a substantially plate fin plate extending peripherally outward from the joined edge portions, the fin plates of the stacked plate pairs being spaced apart and substantially parallel to each other;

wherein the central portions are substantially planar and have a first plurality of obliquely orientated, parallel ribs formed thereon, the ribs of the first and second plates in each plate pair cooperating to form at least a portion of the fluid passages in back-to-back plates of adjacent plate pairs and for each plate pair having a fin plate, the plate pair has elongate, parallel spaced apart first and second edges, the fluid passage being located between the spaced apart first and second edges and extending at an angle that is non-parallel to the first and second edges, and the ribs on at least one of the first and second plates are orientated to be close to parallel to the first and second edges.

15. The heat exchanger of claim 12 wherein each fin plate includes a second plurality of obliquely orientated, parallel ribs formed thereon at a different oblique angle than the first plurality of ribs, the second plurality of ribs of the first and second plates in each plate pair cooperating to form a further portion of the fluid passage.

16. The heat exchanger of claim 1 wherein the central portions are substantially planar and have a plurality of protrusions formed thereon for augmenting fluid flow through the fluid passage.

17. A stacked plate heat exchanger comprising:

a plurality of stacked plate pairs, each plate pair including first and second plates having elongate central portions surrounded by sealably joined edge portions with an elongate fluid passage defined between the central portions; each plate pair having spaced apart inlet and outlet openings in flow communication with the fluid passage, at least some of the plate pairs having a substantially planar fin plate extending peripherally outward from the joined edge portions, the fin plates of the stacked plate pairs being spaced apart and substantially parallel to each other;

wherein for the at least some plate pairs having fin plates, the first plate includes a laterally extending flange around an outer edge of the edge portion thereof, the edge portion of the second plate being nested within the laterally extending flange, the fin plate extending outward from an edge of the laterally extending flange.

18. A stacked plate heat exchanger comprising:

a plurality of stacked plate pairs, each plate pair including first and second plates having elongate central portions surrounded by sealably joined edge portions with an elongate fluid passage defined between the central portions; each plate pair having spaced apart inlet and outlet openings in flow communication with the fluid passage, at least some of the plate pairs having a substantially planar fin plate extending peripherally outward from the joined edged portions, the fin plates of the stacked plate pairs being spaced apart and substantially parallel to each other;

wherein spaced apart external protrusions are formed on the fin plates for augmenting flow of an external fluid thereacross and the protrusions are located only on a downstream half of the fin plates.

19. The heat exchanger of claim 18 wherein the protrusions are dimples.

20. A stacked plate heat exchanger comprising:

a plurality of stacked plate pairs, each plate pair including first and second plates having elongate central portions surrounded by sealably joined edge portions with an elongate fluid passage defined between the central portions: each plate pair having spaced apart inlet and outlet openings in flow communication with the fluid passage, at least some of the plate pairs having a substantially planar fin plate extending peripherally outward from the joined edge portions, the fin plates of the stacked plate pairs being spaced apart and substantially parallel to each other;

wherein spaced apart external protrusions are formed on the fin plates for augmenting flow of an external fluid thereacross and the protrusions are located only on an upstream half of the fin plates.

21. A stacked plate heat exchanger comprising:

a plurality of stacked plate pairs, each plate pair including first and second plates having elongate central portions surrounded by sealably joined edge portions with an elongate fluid passage defined between the central portions; each plate pair having spaced apart inlet and outlet openings in flow communication with the fluid passage, at least some of the plate pairs having a substantially planar fin plate extending peripherally outward from the joined edge portions, the fin plates of the stacked plate pairs being spaced apart and substantially parallel to each other;

wherein the central portions are substantially planar and have a first plurality of obliquely orientated, parallel ribs formed thereon, the ribs of the first and second plates in each plate pair cooperating to form at least a portion of the fluid passage in back-to-back plates of adjacent plate pairs and the ribs of the back-to-back plates are parallel and in contact along a length thereof.

22. A stacked plate heat exchanger comprising a stack of aligned plate pairs, each plate pair including two plates having elongated central portions defining an elongate fluid passage having spaced apart inlet and outlet openings, each plate pair including an elongate fin plate extending peripherally from the fluid passage, the fin plate having elongate, parallel spaced apart first and second edges, the fluid passage longitudinally located between the spaced apart first and second edges and extending at a non-parallel angle relative to the first and second edges.

23. A stacked plate heat exchanger comprising a stack of aligned plate pairs, each plate pair including two plates having elongated central portions defining an elongate fluid passage having spaced apart inlet and outlet openings, each plate pair including an elongate fin plate extending peripherally from the fluid passage, the fin plate having elongate, parallel spaced apart first and second edges, the fluid passage longitudinally located between the spaced apart first and second edges and extending at an angle relative to the first and second edges;

wherein the elongate central portions are surrounded by sealably joined edge portions, the edge portion of the first plate including a laterally extending peripheral locating wall surrounding an outer circumference of the edge portion of the second plate.

* * * * *

UNITED STATES PATENT AND TRADEMARK OFFICE

CERTIFICATE OF CORRECTION

PATENT NO. : 6,889,758 B2
DATED : May 10, 2005
INVENTOR(S) : Burgers et al.

It is certified that error appears in the above-identified patent and that said Letters Patent is hereby corrected as shown below:

Column 11,
Line 13, please delete first occurrence of “plate” and insert -- planar --.
Line 21, please delete “passages” and insert -- passage --.

Signed and Sealed this

Fifteenth Day of November, 2005

JON W. DUDAS
*Director of the United States Patent and Trademark Office*